US007734211B2

(12) United States Patent
Hara

(10) Patent No.: US 7,734,211 B2
(45) Date of Patent: Jun. 8, 2010

(54) IMAGE FORMING APPARATUS AND RETREAT METHOD OF SWITCH UNIT OF IMAGE FORMING APPARATUS

(75) Inventor: Kazuhiro Hara, Numazu (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 890 days.

(21) Appl. No.: 11/476,349

(22) Filed: Jun. 28, 2006

(65) Prior Publication Data

US 2007/0003310 A1 Jan. 4, 2007

(30) Foreign Application Priority Data

Jun. 30, 2005 (JP) ..... 2005-192418

(51) Int. Cl.
*G03G 15/00* (2006.01)

(52) U.S. Cl. ..... 399/90; 399/111; 399/116; 399/121

(58) Field of Classification Search ..... 399/90, 399/111, 116, 121
See application file for complete search history.

(56) References Cited

U.S. PATENT DOCUMENTS 5,216,246 A * 6/1993 Weldman et al. ..... 250/229
5,559,581 A * 9/1996 Sugiura et al. ..... 399/111
6,032,004 A * 2/2000 Mirabella et al. ..... 399/90
6,757,504 B2 * 6/2004 Amano ..... 399/90
7,333,745 B2 * 2/2008 Han et al. ..... 399/90
2003/0072584 A1 * 4/2003 Cho ..... 399/110

FOREIGN PATENT DOCUMENTS

JP 09167536 A * 6/1997
JP 2003005592 A * 1/2003

OTHER PUBLICATIONS

Electronic Translation of JP 09167536 A, Sawa.*

* cited by examiner

*Primary Examiner*—David M Gray
*Assistant Examiner*—Ryan D Walsh
(74) *Attorney, Agent, or Firm*—Turocy & Watson, LLP

(57) ABSTRACT

The present invention has been made to provide a technique by which a switch unit that is disposed on the side surface of an apparatus body and shuts off, at maintenance time, power supply to predetermined electric components provided in the apparatus does not interfere with pull-out operation of a predetermined unit configured to be capable of being withdrawn from the side surface of the apparatus body without sacrificing the miniaturization of the apparatus.

An image forming apparatus comprising: a predetermined unit capable of being withdrawn from the side surface of the apparatus body; a switch unit that is provided on the side surface of the apparatus body and that shuts off power supply to predetermined electric components in the apparatus body at maintenance time; and a retreat mechanism that retreats the switch unit to a position that does not interfere with withdrawal operation of the predetermined unit when the predetermined unit needs to be withdrawn from the side surface of the apparatus body.

27 Claims, 6 Drawing Sheets

IMAGE FORMING APPARATUS AND RETREAT METHOD OF SWITCH UNIT OF IMAGE FORMING APPARATUS

BACKGROUND OF THE INVENTION

1. Field of the Invention

The present invention relates to an image forming apparatus and retreat method of a switch unit of the image forming apparatus.

2. Description of the Related Art

In order to realize accurate color matching and low jitter drive in an image forming apparatus that forms a toner image on a sheet using an intermediate transfer member, it is desirable that an intermediate transfer member unit and a drive source be connected to each other via a coupling mechanism.

In general, in order to realize a configuration in which an intermediate transfer member unit and a motor serving as a drive source are connected to each other via a coupling mechanism as well as the intermediate transfer member unit is made removable for ease of maintenance, it is preferable to employ a configuration in which the intermediate transfer member unit is withdrawn from the side surface of an apparatus body. This configuration is advantageous also in terms of simplification of an apparatus structure.

For the above reason, there has been proposed a technique of employing a configuration in which an intermediate transfer member unit, a photoconductor unit, or the like can be withdrawn from the side surface of an apparatus body for the purpose of increasing maintainability and adopting a mechanism capable of realizing high quality image formation.

In a conventional image forming apparatus having the configuration described above, when the intermediate transfer member unit, a photoconductor unit, or the like is withdrawn from the side surface of an apparatus body, a front cover or side cover provided on the side surface of the apparatus body is firstly opened.

Electric components that use a high-voltage current, such as an intermediate transfer member unit and photoconductor unit, exist in an image forming apparatus. Therefore, in general, a switch unit (so-called an interlock switch unit) that shuts off power supply to the electric components such as an intermediate transfer member unit and photoconductor unit is provided when the front cover or side cover is opened for maintenance work.

In a configuration in which the switch unit as described above is provided, it is often the case that both the front cover and side cover serve as one switch unit due to space limitation or cost issues.

If the configuration in which both the front cover and side cover serve as one switch unit is employed, the switch unit is inevitably disposed on the side surface of an apparatus body. Thus, when a unit such as an intermediate transfer member unit or photoconductor unit is withdrawn from the side surface of an apparatus body, the switch unit may interfere with the withdrawal operation of the above unit.

SUMMARY OF THE INVENTION

The present invention has been made to solve the above problem, and an object thereof is to provide a technique by which a switch unit that is disposed on the side surface of an apparatus body and shuts off, at maintenance time, power supply to predetermined electric components provided in the apparatus does not interfere with pull-out operation of a predetermined unit configured to be capable of being withdrawn from the side surface of the apparatus body without sacrificing the miniaturization of the apparatus.

To solve the above problem, according to the present invention, there is provided an image forming apparatus comprising: a predetermined unit capable of being withdrawn from the side surface of the apparatus body; a switch unit that is provided on the side surface of the apparatus body and that shuts off power supply to predetermined electric components in the apparatus body at maintenance time; and a retreat mechanism that retreats the switch unit to a position that does not interfere with withdrawal operation of the predetermined unit when the predetermined unit needs to be withdrawn from the side surface of the apparatus body.

To solve the above problem, according to the present invention, there is provided a switch unit retreat method, comprising a step that rotates about a predetermined shaft a switch unit which is provided on the side surface of an image forming apparatus for shutting off power supply to predetermined electric components in the apparatus body at maintenance time when a predetermined unit, which is provided on the side surface of the image forming apparatus and is capable of being withdrawn from the side surface of the apparatus body, needs to be withdrawn therefrom to thereby allow the switch unit to retreat to a position that does not interfere with withdrawal operation of the predetermined unit.

As described above in detail, according to the present invention, it is possible to provide a technique by which a switch unit that is disposed on the side surface of an apparatus body and shuts off, at maintenance time, power supply to predetermined electric components provided in the apparatus does not interfere with pull-out operation of a predetermined unit configured to be capable of being withdrawn from the side surface of the apparatus body without sacrificing the miniaturization of the apparatus.

DETAILED DESCRIPTION OF THE PREFERRED EMBODIMENTS

An embodiment of the present invention will be described below with reference to the accompanying drawings.

Figure 1:
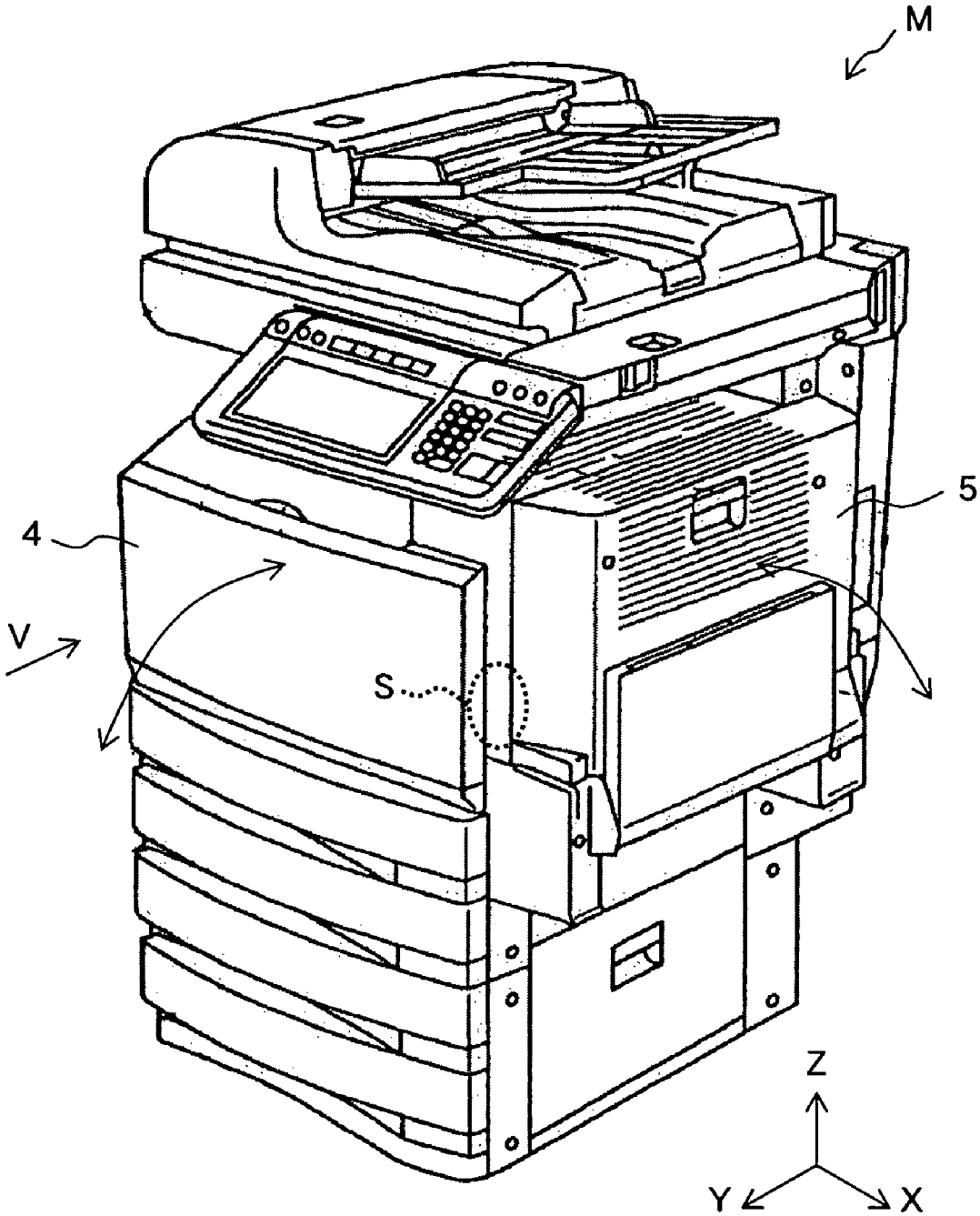
FIG. 1 is a view showing the outer appearance of an image forming apparatus according to an embodiment of the present invention.

FIG. 1 is a view showing the outer appearance of an image forming apparatus according to an embodiment of the present invention. The image forming apparatus according the present embodiment is, e.g., a so-called Multi Function Peripheral (MFP) image forming apparatus.

As shown in FIG. 1, the image forming apparatus M according to the present embodiment has, on the side surface thereof, front and side covers 4 and 5 for maintenance. The front and side covers 4 and 5 are capable of being opened and closed in the directions denoted by arrows in FIG. 1, respectively. A switch unit (power supply shut-off section.) 1 (to be described later) shared by both the front and side covers 4 and 5 is disposed in the vicinity of a position S (in the vicinity of a corner portion of the image forming apparatus M in substantially a horizontal plane) on the side surface of the apparatus, which is denoted by a dotted circle.

The front cover 4 is opened when predetermined units, such as a photoconductor unit, intermediate transfer member unit, or developer unit needs to be withdrawn from the side surface of the apparatus body.

The side cover 5 is opened when a user needs to deal with jamming of sheet which is fed from a sheet cassette to a transfer position at which the intermediate transfer member unit transfers a toner image onto the sheet, or which is fed from a manual sheet holder.

When at least one of the front cover 4 and side cover 5 is opened, the switch unit is activated to shut off power supply to predetermined electric components in the apparatus, such as the photoconductor unit and intermediate transfer member unit.

Figure 2:
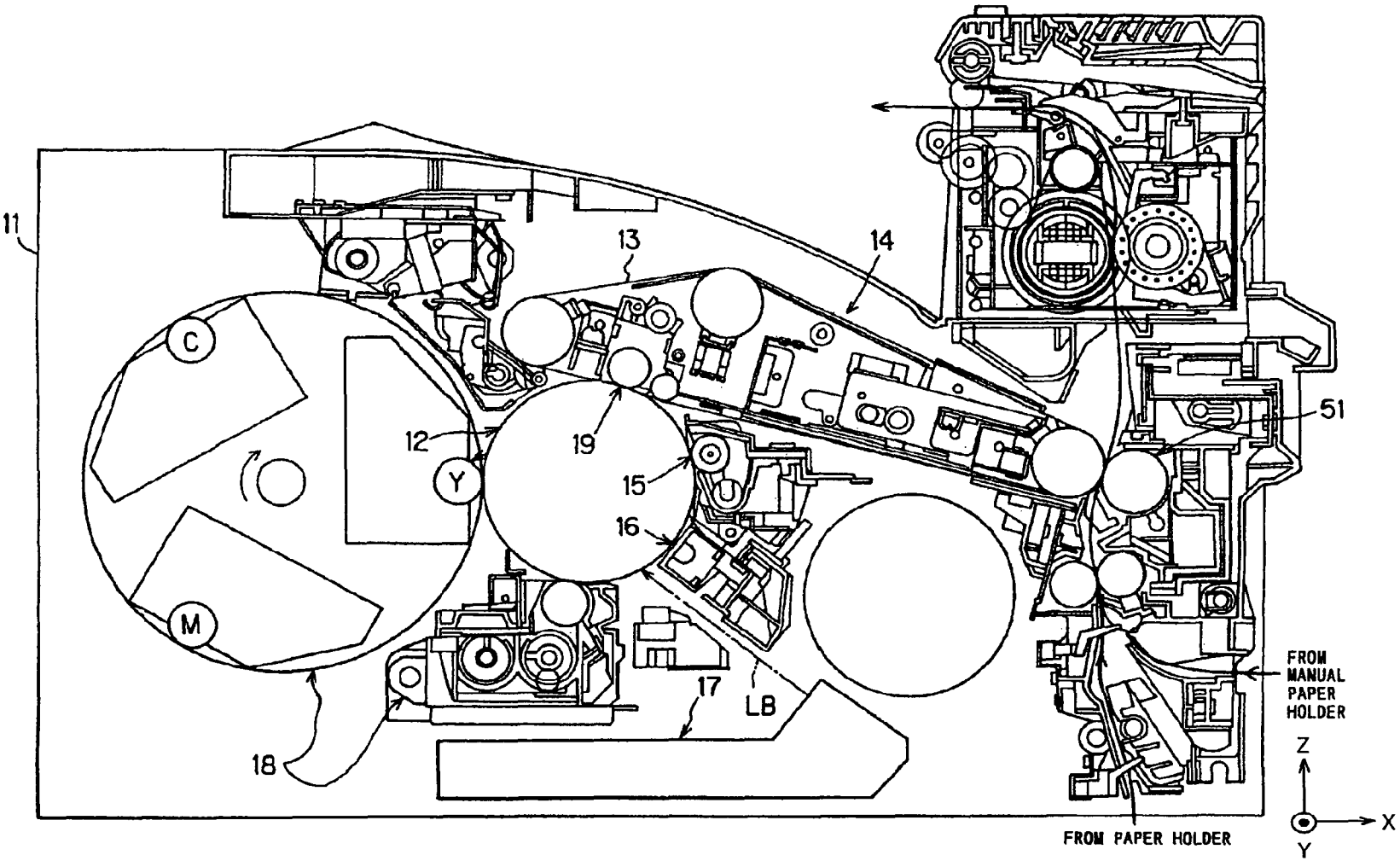
FIG. 2 is a view showing an internal configuration of the image forming apparatus, focusing on the portion in the vicinity of a front cover 4, as viewed from the direction of the arrow V in FIG. 1.

FIG. 2 is a view showing an internal configuration of the image forming apparatus, focusing on the portion in the vicinity of the front cover 4, as viewed from the direction of the arrow V in FIG. 1.

As shown in FIG. 2, the image forming apparatus M according to the present embodiment has a photoconductor drum (included in the photoconductor unit) 12 which is rotatably supported, and an intermediate transfer unit (corresponding to the intermediate transfer member unit) 14 provided with an intermediate transfer belt 13. The photoconductor drum 12 and intermediate transfer unit 14 constitute one unit 3 (see FIG. 3). The unit 3 is capable of being withdrawn through the front cover 4 provided on the front side of a main body casing 11 of the image forming apparatus M.

A drum cleaner unit 15, a charger unit 16, a laser optical unit 17, a developer unit 18, and a primary transfer unit 19 are located around the photoconductor drum 12. The drum cleaner unit 15 cleans the surface of the photoconductor drum 12. The charger unit 16 uniformly charges the surface of the cleaned drum to a required potential. The laser optical unit 17 irradiates the uniformly charged drum surface with a laser beam LB to form an electrostatic latent image. The primary transfer unit 19 transfers the toner image onto the intermediate transfer belt 13. The toner image transferred onto the intermediate transfer belt 13 as described above is then transferred onto a sheet that has been fed to a secondary transfer unit 51.

Figure 3:
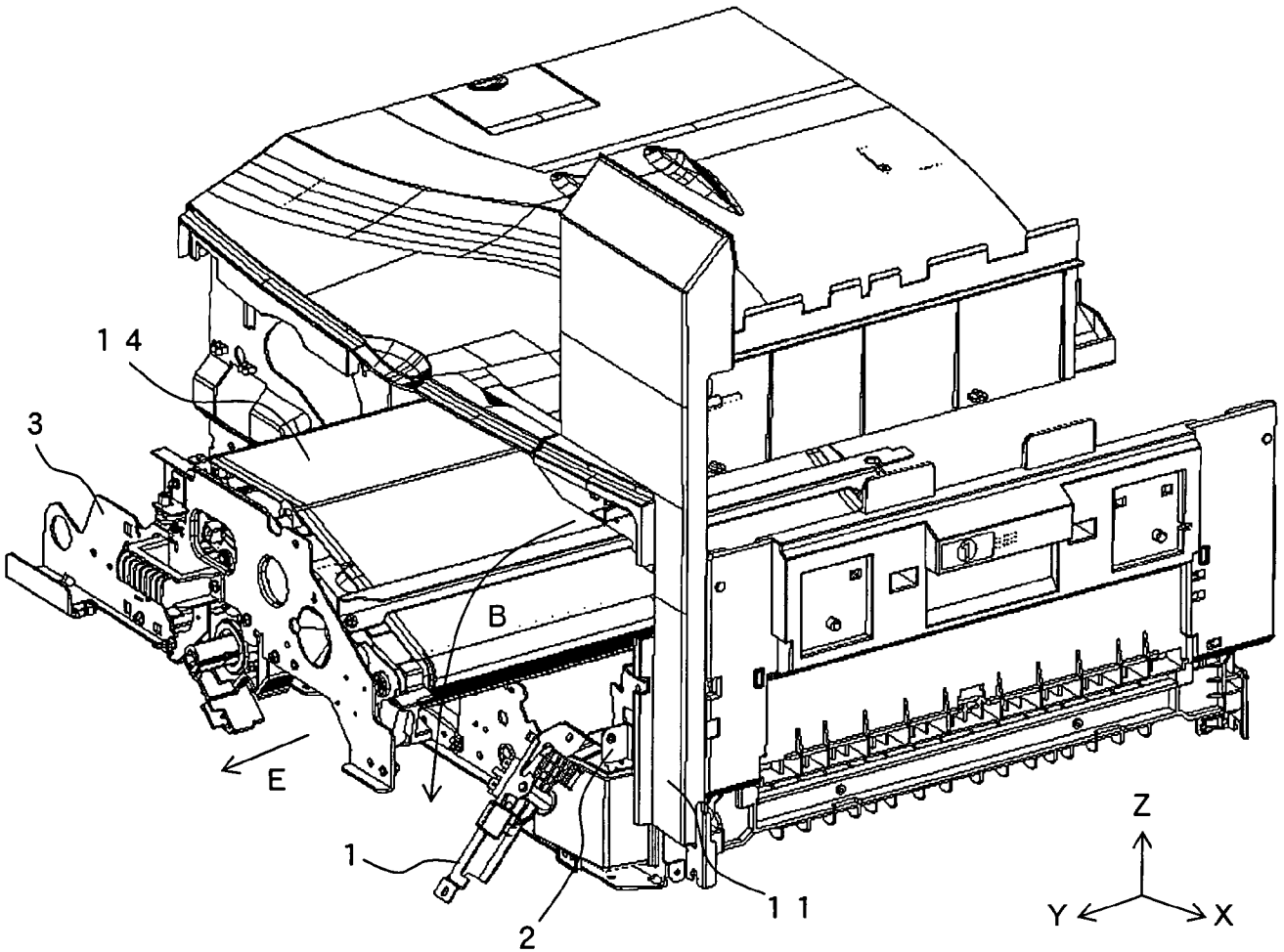
FIG. 3 is a view showing a state where an intermediate transfer unit 14 and photoconductor drum 12 are withdrawn from the side surface of the apparatus on which the front cover 4 is opened.

FIG. 3 is a view showing a state where the intermediate transfer unit 14 and photoconductor drum 12 are withdrawn from the side surface of the apparatus on which the front cover 4 is opened.

As shown in FIG. 3, in the image forming apparatus M according to the present embodiment, the switch unit 1 is supported by a retreat mechanism (retreat section) 2 so as to be rotatable with respect to the main body casing 11.

Figure 4:
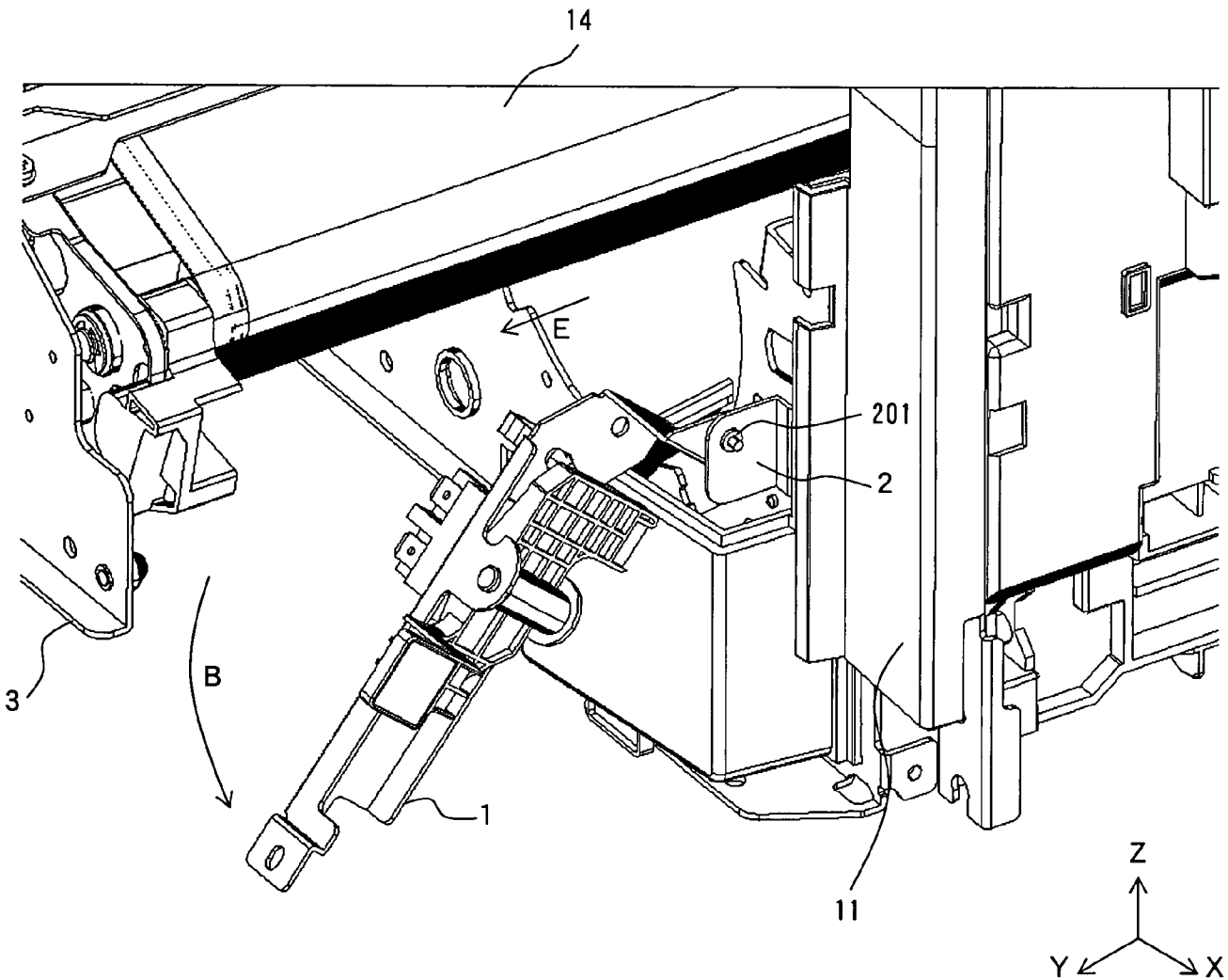
FIG. 4 is an enlarged view showing a peripheral part of a switch unit 1 in a state shown in FIG. 3.

FIG. 4 is an enlarged view showing a peripheral part of the switch unit 1 in a state shown in FIG. 3. As shown in FIG. 4, the switch unit 1 is made rotatable in the direction of the arrow B about a rotary shaft (corresponding to a predetermined shaft) 201 provided in the retreat mechanism 2. With this configuration, it is possible to retreat the switch unit 1 to a position that does not interfere with the withdrawal operation of a predetermined unit such as the intermediate transfer unit 14 or photoconductor drum 12 when the predetermined unit is withdrawn from the side surface of the apparatus in the direction of the arrow E.

As a result, it is possible to easily withdraw a predetermined unit from the side surface of the apparatus body without sacrificing the miniaturization of the apparatus, eliminating the need to provide a complicated mechanism like a configuration in which a predetermined unit is withdrawn from the upper part of the apparatus and preventing degradation of the operation accuracy.

Further, owing to the configuration in which the switch unit 1 is supported by the retreat mechanism 2 so as to be rotatable with respect to the main body casing 11, it is possible to prevent an overpowering load from being applied to a harness connecting the switch unit 1 and inside of the apparatus. Further, since the switch unit 1 is coupled to the main body casing 11 by the retreat mechanism 2, there is no possibility that the switch unit 1 is lost. Further, the rotary shaft 201 is provided near the end portion of the switch unit 1, so that it is possible to effectively retreat the switch unit 1 with a small rotation angle. Further, the rotary shaft 201 is disposed so that the switch unit 1 is rotated in substantially a vertical plane, making it easy to fix the end portion of the switch unit 1 on the side that the rotary shaft 201 is not provided to the main body casing 11.

Although the switch unit 1 is supported by the retreat mechanism 2 so as to be rotatable with respect to the main body casing 11 in the present embodiment, the configuration of the switch unit 1 is not limited to this. For example, the switch unit 1 may be configured to be completely detachable from the main body casing 11.

Figure 5:
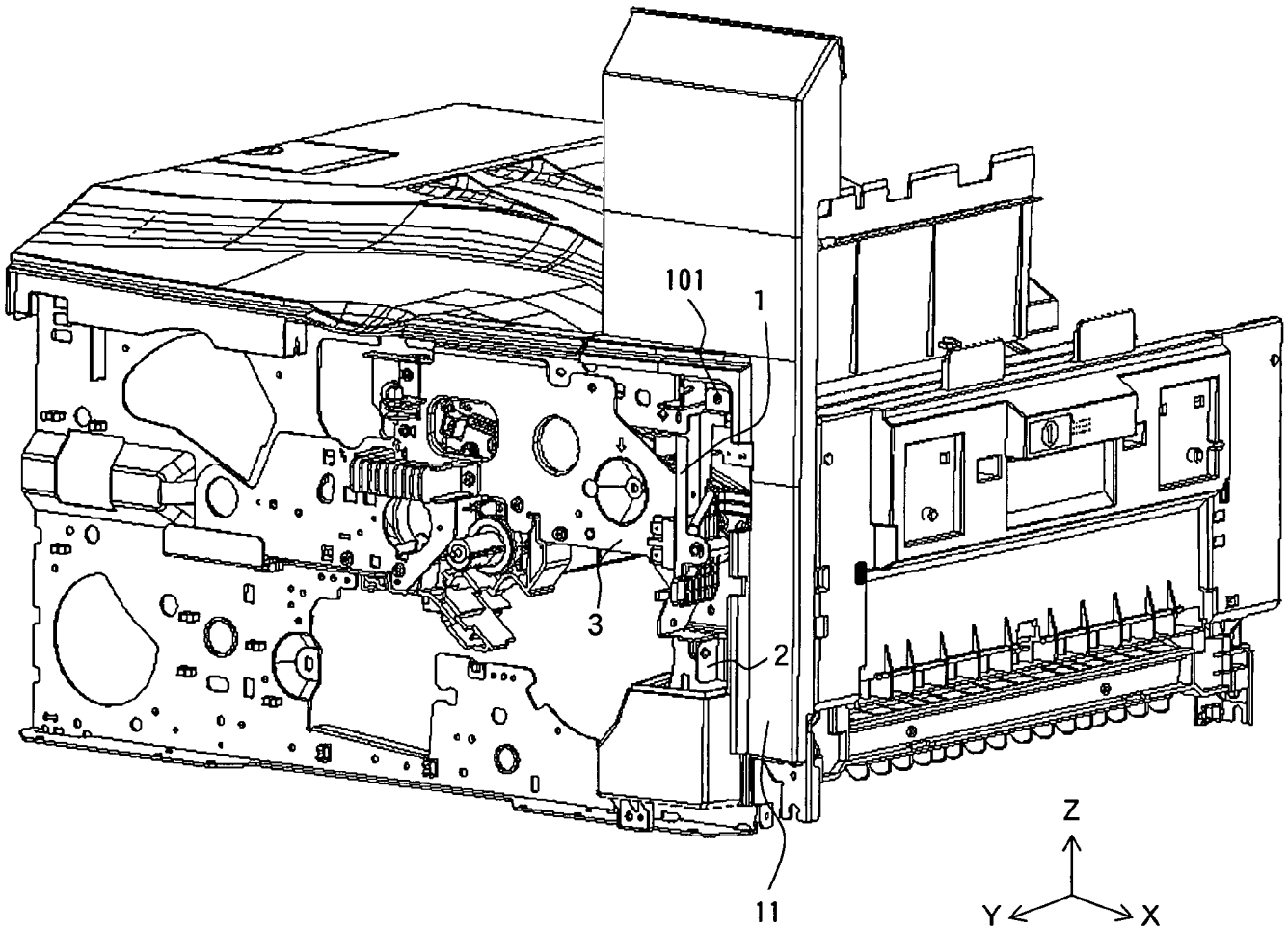
FIG. 5 is a view showing a state where the intermediate transfer unit 14 and photoconductor drum 12 are housed in the apparatus body, and where the switch unit 1 is closed (a state where the switch unit 1 is not moved to a retreat position)
Figure 6:
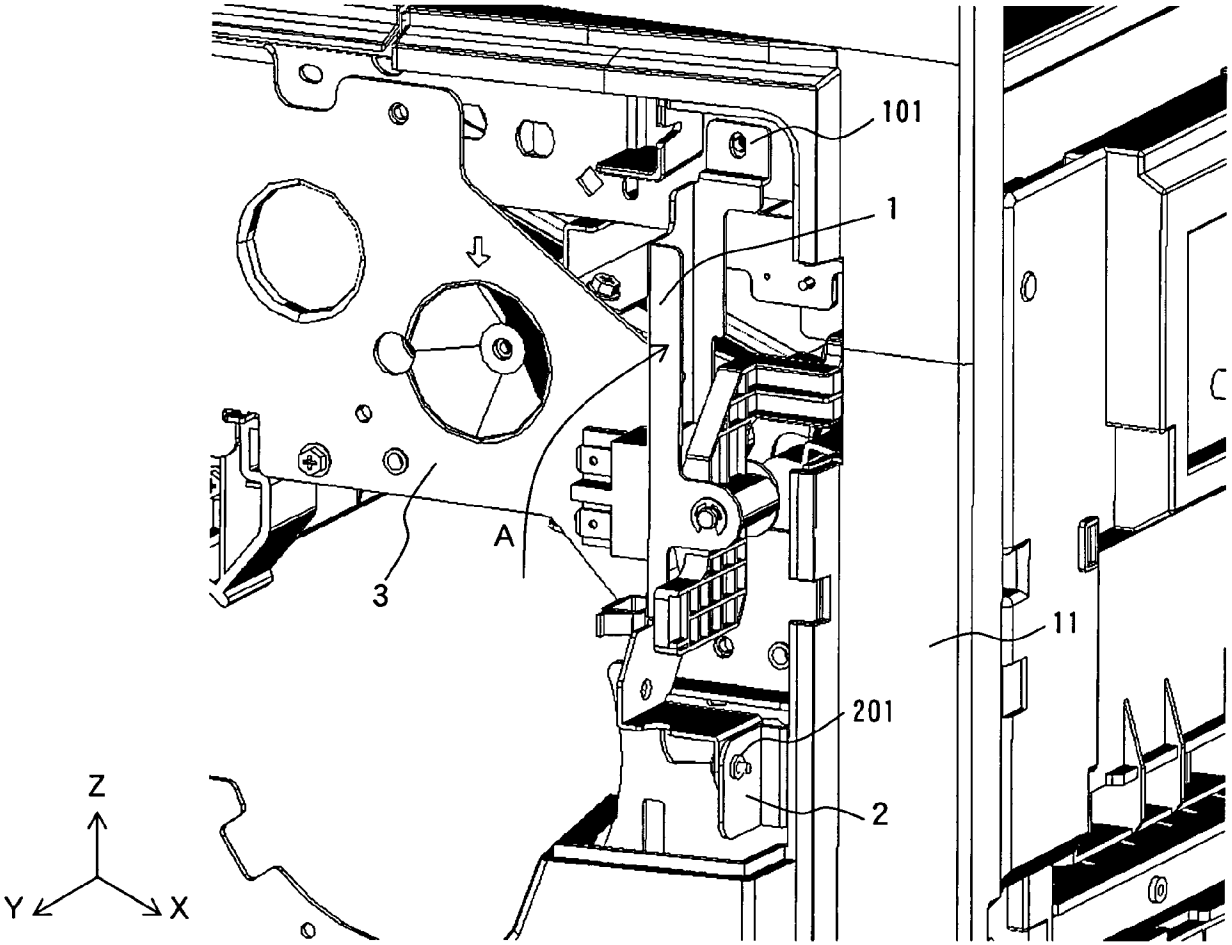
FIG. 6 is an enlarged view showing a peripheral part of the switch unit 1 in a state shown in FIG. 5.

FIG. 5 is a view showing a state where the intermediate transfer unit 14 and photoconductor drum 12 are housed in the apparatus body, and where the switch unit 1 is also housed in the apparatus body (a state where the switch unit 1 is not situated in a retreat position). FIG. 6 is an enlarged view showing a peripheral part of the switch unit 1 in a state shown in FIG. 5.

As shown in FIGS. 5 and 6, the switch unit 1 is rotated about the rotary shaft 201 provided in the retreat mechanism 2 in the direction of the arrow A and housed in the apparatus body. At this housing position, a fixing portion 101 of the switch unit 1 is fixed to the main body casing 11 by a screw or bolt.

Although the switch unit 1 is fixed to the main body casing 11 as a single body in the present embodiment, the configuration of the switch unit 1 is not limited to this. For example, a configuration may be adopted, in which fixing holes are so formed in the switch unit 1 and unit 3 as to be overlapped with each other in a state where the unit 3 is housed in the apparatus body, and a common screw (fixing member) is used to fix the fixing portion (fixing hole) of the unit 3 and the fixing portion (fixing hole) 101 of the switch unit 1 to the main body casing 11.

By fixing the switch unit 1 and a predetermined unit to the main body casing 11 using a common fixing member, it is possible to reduce the number of fixing parts. The switch unit 1 needs to be opened when the predetermined unit is withdrawn, so that if the fixing member for fixing both the units is removed with a single operation, maintenance efficiency is improved.

Although an exemplary embodiment of the present invention has been shown and described, it will be apparent to those having ordinary skill in the art that a number of changes, modifications, or alterations to the invention may be made within the spirit and scope of the present invention.

What is claimed is:

1. An image forming apparatus comprising:

a withdraw unit withdrawn from the side surface of the apparatus body;

a switch unit that is provided on the side surface of the apparatus body and which shuts off power supply to predetermined electric components in the apparatus body at maintenance time; and a retreat mechanism that supports the switch unit to rotate the switch unit about a predetermined shaft and retreats the switch unit to a position that does not interfere with withdrawal operation of the withdraw unit when the withdraw unit is withdrawn from the side surface of the apparatus body.

2. The image forming apparatus according to claim 1, wherein the predetermined shaft is positioned near the end portion of the switch unit.

3. The image forming apparatus according to claim 2, wherein the withdraw unit is a photoconductor unit.

4. The image forming apparatus according to claim 2, wherein the withdraw unit is an intermediate transfer member unit.

5. The image forming apparatus according to claim 1, wherein the predetermined shaft is disposed so that the switch unit is rotated in substantially a vertical plane.

6. The image forming apparatus according to claim 5, wherein the withdraw unit is a photoconductor unit.

7. The image forming apparatus according to claim 5, wherein the withdraw unit is an intermediate transfer member unit.

8. The image forming apparatus according to claim 1, wherein the switch unit and withdraw unit are fixed to the apparatus main body by a common fixing member in a state where the withdraw unit is housed in the apparatus body.

9. The image forming apparatus according to claim 8, wherein fixing holes are so formed in the switch unit and withdraw unit as to be overlapped with each other in a state where the withdraw unit is housed in the apparatus body, and a common screw is inserted into the overlapped fixing holes to thereby fix the switch unit and withdraw unit to the apparatus main body.

10. The image forming apparatus according to claim 9, wherein the withdraw unit is a photoconductor unit.

11. The image forming apparatus according to claim 9, wherein the withdraw unit is an intermediate transfer member unit.

12. The image forming apparatus according to claim 8, wherein the withdraw unit is a photoconductor unit.

13. The image forming apparatus according to claim 8, wherein the withdraw unit is an intermediate transfer member unit.

14. The image forming apparatus according to claim 1, wherein the switch unit is disposed in the vicinity of a corner portion of the image forming apparatus in substantially a horizontal plane.

15. The image forming apparatus according to claim 14, wherein the withdraw unit is a photoconductor unit.

16. The image forming apparatus according to claim 14, wherein the withdraw unit is an intermediate transfer member unit.

17. The image forming apparatus according to claim 1, wherein the withdraw unit includes an intermediate transfer belt that supports a toner image developed on a photoconductor unit facing to a plurality of developer units.

18. The image forming apparatus according to claim 17, wherein the withdraw unit is a photoconductor unit.

19. The image forming apparatus according to claim 17, wherein the withdraw unit is an intermediate transfer member unit.

20. The image forming apparatus according to claim 1, wherein the withdraw unit is a photoconductor unit.

21. The image forming apparatus according to claim 1, wherein the withdraw unit is an intermediate transfer member unit.

22. An image forming apparatus comprising:

a withdraw unit withdrawn from the side surface of the apparatus body;

a power supply shutter means provided on the side surface of the apparatus body for shutting off power supply to predetermined electric components in the apparatus body at maintenance time; and a retreat means for supporting the power supply shutter means to rotate the power supply shutter means about a predetermined shaft and for retreating the power supply shutter unit to a position that does not interfere with withdrawal operation of the withdraw unit when the withdraw unit is withdrawn from the side surface of the apparatus body.

23. The image forming apparatus according to claim 22, wherein the power supply shutter means and withdraw unit are fixed to the apparatus main body by a common fixing means in a state where the withdraw unit is housed in the apparatus body.

24. The image forming apparatus according to claim 22, wherein the withdraw unit includes an intermediate transfer belt that supports a toner image developed on a photoconductor unit facing to a plurality of developer units.

25. An image forming apparatus comprising:

a withdraw unit withdrawn from the side surface of the apparatus body;

a switch unit that is provided on the side surface of the apparatus body and which shuts off power supply to the withdraw unit in the apparatus body at maintenance time; and a retreat mechanism that supports the switch unit to rotate the switch unit about a predetermined shaft and retreats the switch unit to a position that does not interfere with withdrawal operation of the withdraw unit when the withdraw unit is withdrawn from the side surface of the apparatus body.

26. The image forming apparatus according to claim 25, wherein the withdraw unit is a photoconductor unit.

27. The image forming apparatus according to claim 25, wherein the withdraw unit includes an intermediate transfer belt that supports a toner image developed on a photoconductor unit facing to a plurality of developer units.

* * * * *